US006237659B1

(12) United States Patent
Francis

(10) Patent No.: US 6,237,659 B1
(45) Date of Patent: May 29, 2001

(54) ROTATABLE WORK BENCH

(76) Inventor: David Francis, 13401 Reliance St., Arleta, CA (US) 91331

( * ) Notice: Subject to any disclaimer, the term of this patent is extended or adjusted under 35 U.S.C. 154(b) by 0 days.

(21) Appl. No.: 09/521,063

(22) Filed: Mar. 8, 2000

Related U.S. Application Data

(60) Provisional application No. 60/123,184, filed on Mar. 8, 1999.

(51) Int. Cl.[7] ..... B25H 1/00

(52) U.S. Cl. ..... 144/286.1; 108/59; 144/1.1; 144/286.5; 248/121; 409/173; 269/289 R

(58) Field of Search ..... 144/1.1, 286.1, 144/286.5; 108/59, 62, 179; 248/121, 122.1, 646, 676, 678; 409/173, 221; 269/56, 289 R

(56) References Cited

U.S. PATENT DOCUMENTS 1,506,154 * 8/1924 Berthelsen ..... 144/286.1
2,653,634 * 9/1953 Mott ..... 144/1.1
3,316,947 * 5/1967 Lyche et al. ..... 144/1.1
4,497,353 * 2/1985 Sproat et al. ..... 144/286.1
4,523,617 * 6/1985 Tiedemann ..... 144/286.5
4,665,962 * 5/1987 Ordonez ..... 144/1.1
4,921,378 * 5/1990 Kytola ..... 409/221.1
5,564,483 * 10/1996 Sacchi ..... 144/286.5

* cited by examiner

*Primary Examiner*—W. Donald Bray
(74) *Attorney, Agent, or Firm*—Albert O. Cota

(57) ABSTRACT

A work bench which includes a bench support structure (12) which incorporates a rotatable triangular bench support structure (55) which includes three surfaces to which are attached a first, second and third bench (90,92,94). On the bench surface can be permanently attached a variety of electrical power tools (150) such as a grinder (152) and a router (154). The rotatable work bench (10) can be designed to include an internal electrical power source (89) that is controlled by a master, electrical power switch (88). When the switch (88) is closed power is made available to each of the attached electrical power tools (150) thus, allowing each tool to be turned on by the tool switch. The rotatable work bench (10) can also be designed to have attached a drawer assembly (100), a shelf assembly (112) and a set of casters (124).

20 Claims, 5 Drawing Sheets

ROTATABLE WORK BENCH

This application claims benefit of Provisional No. 60/123,184 filed Mar. 8, 1999.

TECHNICAL FIELD

The invention pertains to the general field of work benches and more particularly to a work bench that can be selectively rotated to provide either a first, second or third work surface.

BACKGROUND ART

Humans have long had a need to manufacture, build or otherwise create. From mankind's earliest origins the most fundamental need has been to provide means of survival. These means have included dwellings, tools and weapons, and other implements. One of the first type of items our ancestors learned to make were tools which have remained an essential part of our development and growth.

Today, there are tools for every imaginable purpose. It has been estimated that in over 80 percent of all homes in America there is at least one hammer and two screwdrivers. There have also been developed tools that assist a person who is using other tools. For people who must work in confined areas there is often space limitations and difficulty providing a suitable work area.

A solution to the confinement problems was provided with the introduction of the all-in-one work bench. These benches are designed to offer a suitable horizontal surface on which a person can hammer, cut, stabilize or simply observe a project. Many of the benches can be folded into a compact size for easy transportation and storage. Some can also be customized with add-on items such as a power supply, vice or other specialized tool.

While these benches do offer an improvement over previous solutions, such as two sawhorses with a piece of plywood on top, there were still deficiencies in their designs. First off, there was usually no storage space available on the bench. Whenever a person did decide to use a particular tool on the bench, he/she would have to take time attaching and securing the tool. For a tool that was used consistently in a particular trade, such as a grinder, it become a burden to repeatedly attach and remove the tool. Even though current workbenches have drawbacks, they continue to be very popular and widely used. Obviously, if there was some type of work bench that could accomplish all of the functions of currently available benches, while also providing improvements, it would be a great benefit.

A search of the prior art, which included U.S. patents and industry catalogs, did not disclose any workbenches that read on the claims of the instant invention.

DISCLOSURE OF THE INVENTION

The rotatable work bench is designed to provide a stationary work surface that can be rotated to one of three positions. In its basic design, the rotatable work bench consists of:

A bench support structure consisting of:

(1) a front frame having attached a front pillow block, (2) a rear frame that is in alignment with the front frame and that has attached a rear pillow block in alignment with the front pillow block, A triangular bench support structure consisting of:

(1) a front assembly having a first member, a second member and a third member, wherein the three members are attached to form an equilateral triangle. From substantially the midpoint of each member of the equilateral triangle extends inward a shaft support rod. The inward ends of the three shaft support rods are rigidly attached to a shaft having a front end and a rear end, wherein the front end is rotatably inserted into the front pillow block, (2) a rear assembly that is in alignment with the front assembly and which has a first member, a second member and a third member. All three members are also attached to form an equilateral triangle. From substantially the midpoint of each member of the equilateral triangle extends inward a shaft support rod. The inward ends of the three shaft support rods are rigidly attached to the shaft. The rear end of the shaft is rotatably inserted into the rear pillow block, A first bench attached to the first members of the front and rear assemblies of said triangular bench support structure, a second bench attached to the second members of the front and rear assemblies of the triangular bench support structure, and a third bench attached to the third member of the front and rear assemblies of said triangular bench support structure, and Means for selectively releasing and locking the triangular bench support structure to a selectable first, second or third bench position.

To at least one of the benches can be attached an electric power tool such as a grinder or a router or, a bench can be used as a flat work surface. In the above basic design electric power is individually connected to the electric power tool. Alternately, the rotatable work bench can be designed with an internal power distribution system that is connected to a 120-volt a-c utility power source and that distributes the power to any electrical power tool attached to the benches. A master power, switch is included to control the application of the a-c power.

To enhance the utility of the invention, a drawer assembly and a shelf assembly can be placed adjacent or rigidly attached to a first side and a second side respectively. Also, to provide mobility the rotatable work bench can include a set of casters.

In view of the above disclosure, it is the primary object of the invention to provide a work bench which includes three work surface that can be easily and quickly selected.

In addition to the primary object of the invention it is also an object of the invention to produce a rotatable work bench that:

can be manufactured from various materials including steel square or round tubing that is attached by a MIG welding process, can include adjustable leveling feet, conserves space, and is cost effective from both a consumers and manufacturers point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
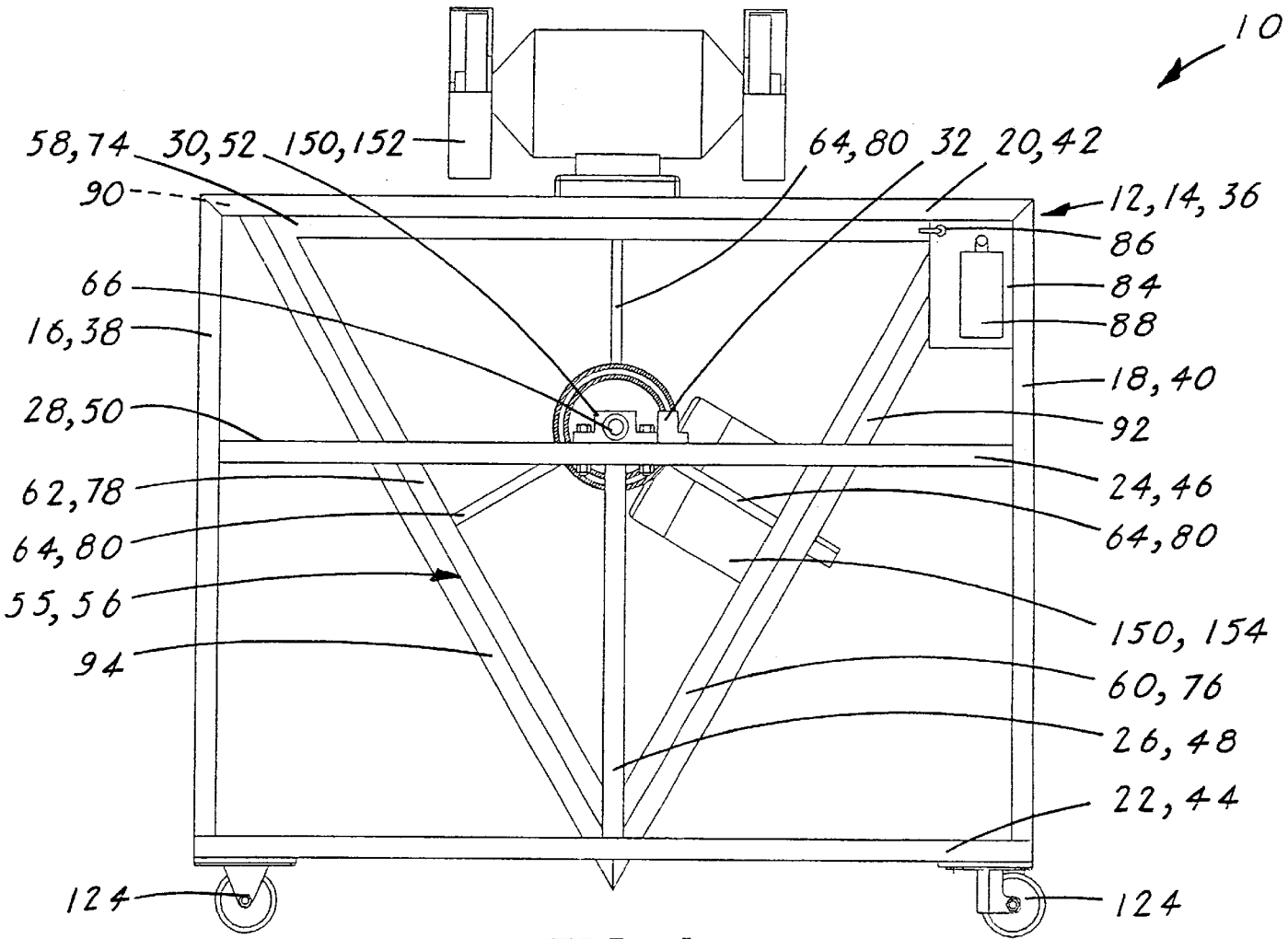
FIG. 1 is a front elevational view of a rotatable work bench with the rotatable work bench rotated to expose a dual grinder and with a router located below the surface.

The best mode for carrying out the rotatable work bench is presented in terms of a preferred embodiment that is disclosed in two designs. The first design is strictly a mechanical design while the second design is also a mechanical design that incorporates an internal electrical power distribution system.

In either design the work bench can be easily rotated to expose one of three benches that can include a fixed electrical power tool. The rotatable work bench, as shown in FIGS. 1–5 is comprised of the following major elements: a bench support structure 12, a front frame 14, a front pillow block 30, an electrical transfer block 32 (second design only), a rear frame 36, a rear pillow block 52, a triangular bench support structure 55, a shaft 66, an electrical-power transfer disc 68 (second design only), a first bench 90, a second bench 92, a third bench 94, a drawer assembly 100, a shelf assembly 11 and a set of casters 124.

First Design

The rotatable work bench 12, as best shown in FIG. 1, is comprised of the front frame 14 and the rear frame 36. Both the front and rear frames 14, 36 are constructed from 1.00 inch steel square tubing having a 0.125 inch wall thickness and are welded together by an MIG welding process.

The front frame 14 includes a left vertical member 16, a right vertical member 18, an upper horizontal member 20, a lower horizontal member 22, an inner horizontal member 24 and an inner vertical member 26. Substantially centered on the upper surface 28 of the inner horizontal member 26 is attached the front pillow block 30, The rear frame 36 is in alignment with the front frame 14 and also includes a left vertical member 38, a right vertical member 40, an upper horizontal member 42, a lower horizontal member 44, an inner horizontal member 46 and an inner vertical member 48. Substantially centered on the upper surface of the inner horizontal member 44 is attached the rear pillow block 52 that is in alignment with the front pillow block 30. Both the front and rear pillow blocks have bronze bearings which will support a 50,000 pound working load.

Figure 2:
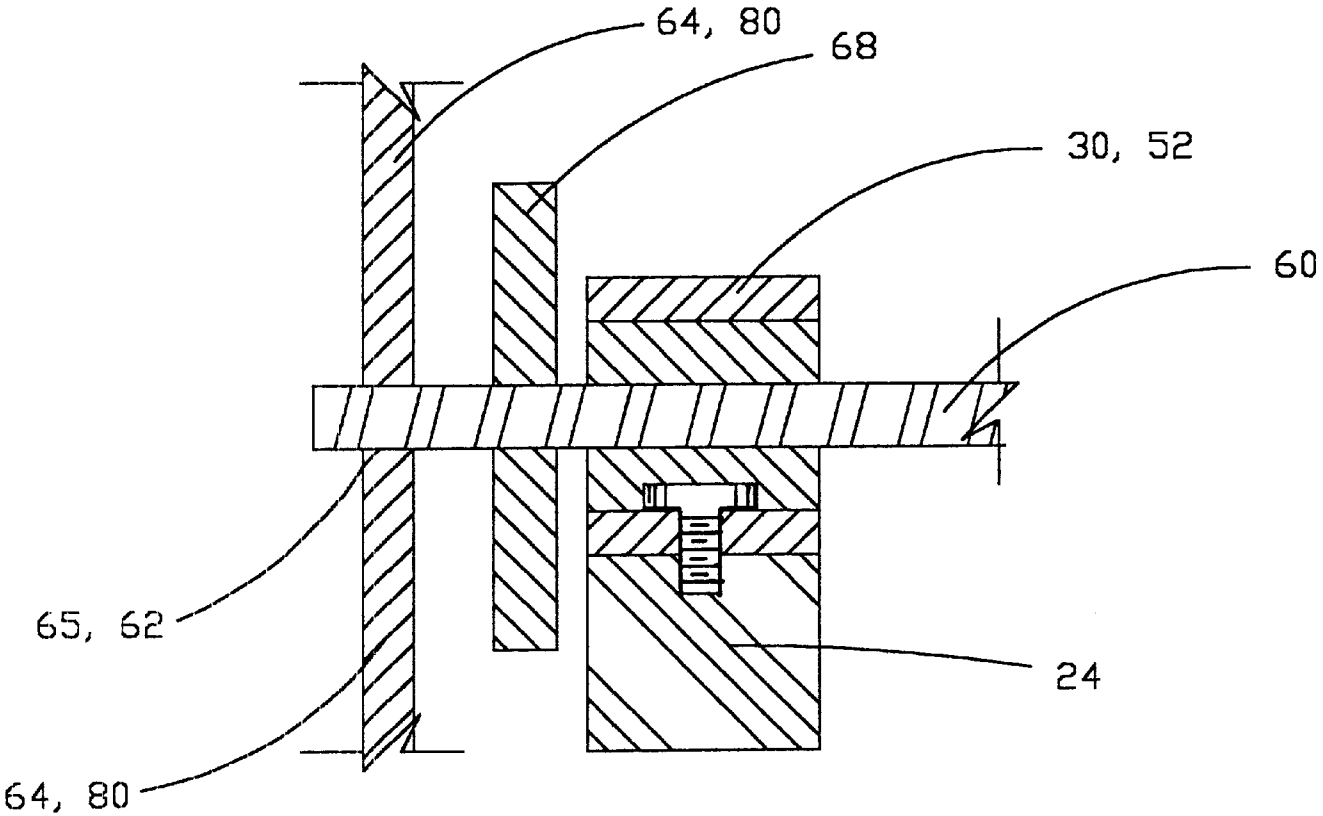
FIG. 2 is a partial sectional view showing the relative location of a pillow block, an electrical-power transfer disc and pair of shaft support rods.

The triangular bench support structure 55, as also shown in FIG. 1, is comprised of a front assembly 56 and a rear assembly 72. The front assembly 56 has a first member 58, a second member 60 and a third member 62, wherein all three of the members are attached to form an equilateral triangle. From substantially the midpoint of each of the first 58, second 60 and third 62 members extends inward toward the shaft 66 a shaft support rod 64. The inward ends 65 of the three shaft support rods 64, as shown in FIG. 2, are rigidly attached by a welding process to the shaft 66 which includes a front end and a rear end. The front end, as also shown in FIG. 2, is rotatably inserted into the front pillow block 30.

The rear assembly 72 is in alignment with the front assembly 56 and also has a first member 74, a second member 76 and a third member 78, wherein all three of the members are attached to form an equilateral triangle. From substantially the midpoint of each of the first 74, second 76 and third 78 members extends inward toward the shaft 66 a shaft support rod 80. The inward ends 82 of the three shaft support rods 80 are also rigidly attached, by a welding process to the shaft 66. The rear end of the shaft 66 is rotatably inserted into the rear pillow block 52.

To utilize the rotatable work bench three benches are utilized. The first bench 90 is attached to the first members 58,74 of the front and rear assemblies 56,72 of the triangular bench support structure 55. The second bench 92 is attached to the second members 60,76 of the front and rear assemblies 56,72 of the triangular bench support structure 55. Likewise the third bench 94 is attached to the third members 62,78 of the front and rear assemblies 56,72 of the triangular bench support structure 55.

Figure 3:
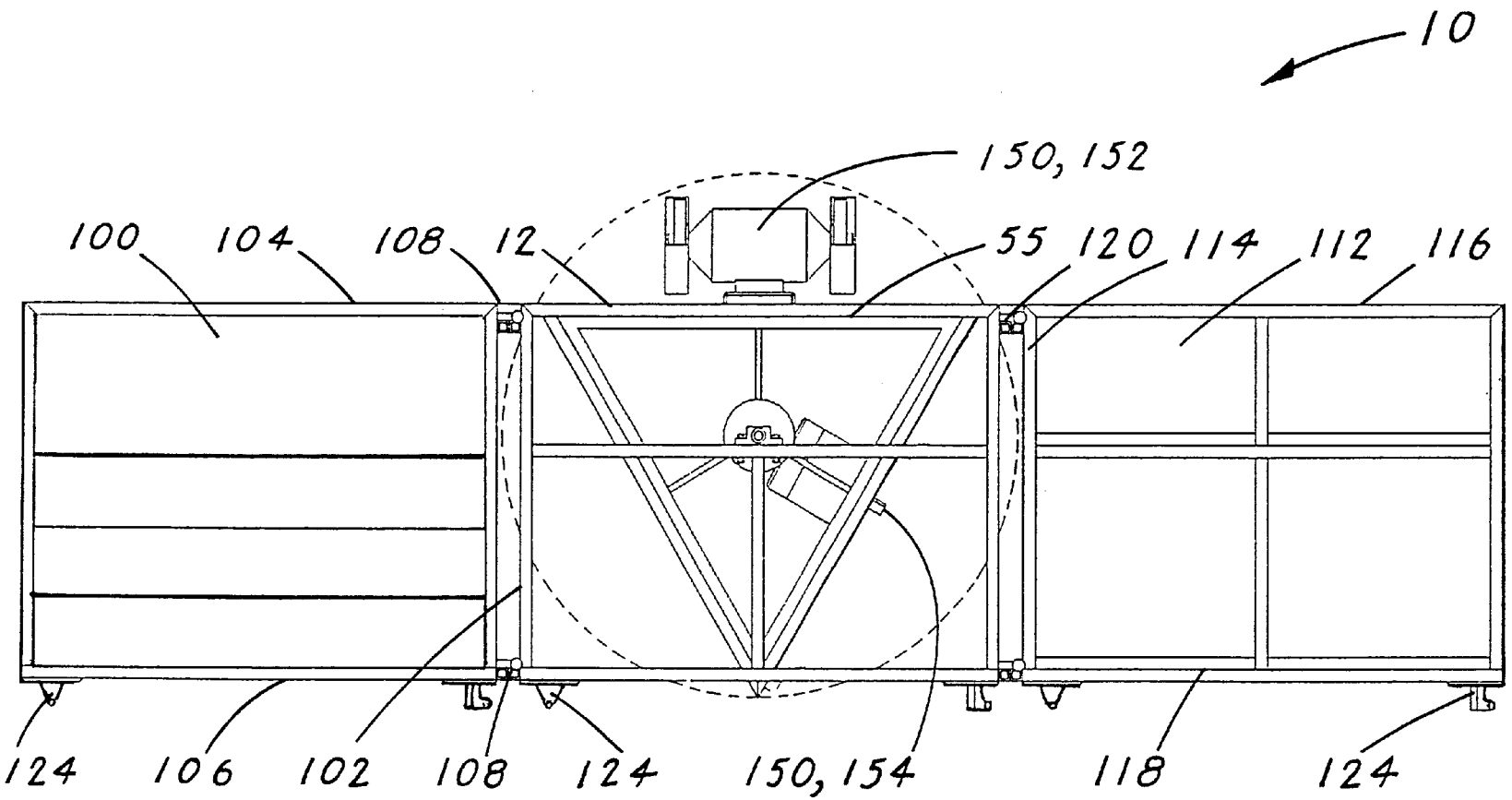
FIG. 3 is a front elevational view of the rotatable work bench having a drawer assembly attached to the left side of the rotatable work bench and a shelf assembly attached to the right side of the rotatable work bench.
Figure 4:
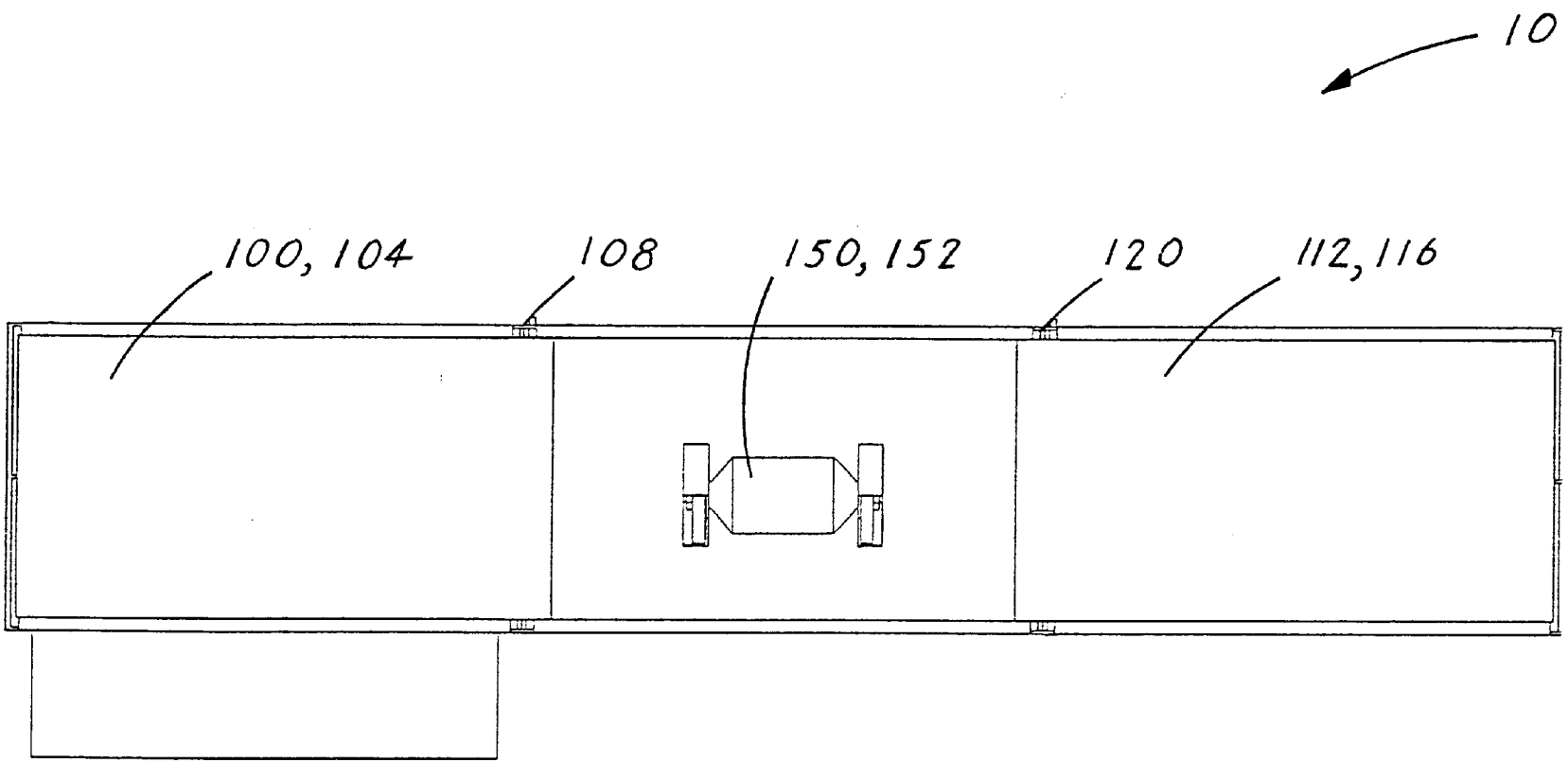
FIG. 4 is a top plan view of the rotatable work bench with the drawer and shelf assemblies attached and with the rotatable work bench rotated to expose the dual grinder.
Figure 5:
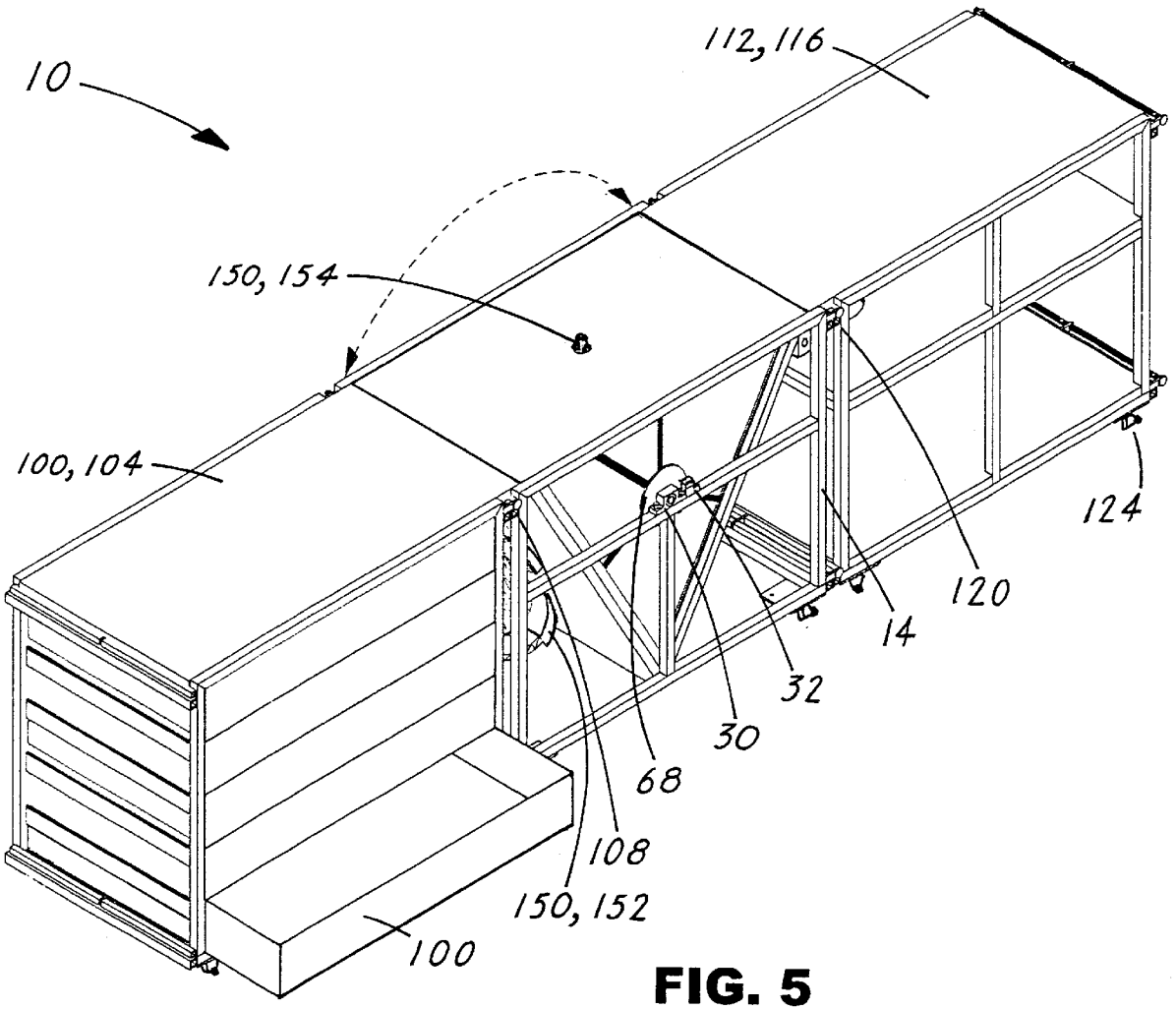
FIG. 5 is a perspective view of the rotatable work bench with the drawer and shelf assemblies attached and with the rotatable work bench rotated to expose the router.

Each of the three benches 90,92,94 are dimensioned to provide a flat working surface or to have an electric power tool 150 such as a dual grinder 152 as shown in FIGS. 1, 3 and 4 or a router 154 as shown retracted in FIGS. 1 and 3 and in a usable position in FIG. 5. In this first design the electric power tool is connected directly to an external power source which typically consists of a utility power source which supplies 120-volts a-c. The surface of the work benches can also have attached a section of carpet or a section of rubber bonded to them for assembly work.

The first design includes a means for selectively releasing and locking the triangular bench support structure 55 at a selectable first, second or third bench position. Typically this means for releasing and locking said triangular bench support structure comprises a trip lever which can be located on a trip lever 86 mounted on a mounting plate 84 attached to a corner of the front frame 14, as shown best in FIG. 1, or by a trip lever 86 that is positioned to be tripped by a foot (not shown). In either case, the lever 86 activates a two-position latch that in a first position maintains the triangular bench support structure 55 in a selected first position and when the latch is placed in a second position, the triangular bench support structure 55 can be rotated to a second or third position.

To enhance the utility of the rotatable work bench it can be made to include a drawer assembly 100 and/or a shelf assembly 112. The drawer assembly 100, as shown in FIGS. 3, 4 and 5, includes a vertical side 102 positioned adjacent to a first side of the bench support structure 12. The drawer assembly also has an upper surface 104 that is in linear alignment with the upper horizontal members 20,42 of the front and rear frames 14,36 and a lower surface 106 in linear alignment with the lower horizontal members 22,44 of the front and rear frames 14,36. The drawer assembly 100 can also be designed to include a drawer attachment means 108 which allows the drawer to be rigidly attached to the first side of the bench support structure 12.

The shelf assembly 112, as also shown in FIGS. 3, 4 and 5, includes a vertical side 114 that is positioned adjacent to a second side of the bench support structure 12. The shelf assembly 112 also has an upper surface 116 in linear alignment with the upper horizontal members 20,42 of the front and rear frames 14,36 and a lower surface 118 in linear alignment with the lower horizontal members 22,44 of the front and rear frames 14,36. The shelf assembly 112 can also be designed to include a shelf attachment means 120 which allows the shelf assembly to be rigidly attached to the second side of the bench support structure 12.

The rotatable work bench 10, as shown in FIGS. 1, 3 and 5, can also be designed to include a set of casters 124 that are attached to the lower surface of the lower horizontal members 22,44 of the front and rear frames 14,36 and to the lower surfaces of the drawer assembly 100 and the shelf assembly 112. The casters 124 preferably consist of two 4.0 inch diameter swivel casters which are attached to one end and two fixed casters 124 attached on the opposite end.

Second Design

The mechanical design features of the second design are identical to the mechanical design features of the first design therefore, they are not be repeated. The difference in the second design is the inclusion of a central utility-power distribution system. This system includes the electrical transfer block 32 and an electrical-power transfer disc 68.

The electrical transfer block 32, as best shown in FIG. 1, is attached to the upper surface 28 of the inner horizontal member 26 adjacent the front pillow block 30. The electrical-power transfer disc 68, as shown in FIGS. 1 and 2, is rigidly attached to the shaft 66. The disc 68 is positioned to interface with the electrical transfer block 32. The a-c power is controlled by an electrical power switch 88 that is preferably mounted to the mounting plate attached to a corner of the front frame as also best shown in FIG. 1. when the switch 88 is closed, the electrical power source is applied sequentially through a set of electrical connectors (not shown), to the electrical transfer block 32, the electrical-power transfer disc 68 from where the power is routed to an electric power tool mounted to at least one of the first, second or third benches 90, 92, 94.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

What is claimed is:

1. A rotatable work bench comprising:

a) a bench support structure comprising:

(1) a front frame having attached a front pillow block, (2) a rear frame in alignment with said front frame and having attached a rear pillow block in alignment with said front pillow block, b) a triangular bench support structure comprising:

(1) a front assembly having a first member, a second member and a third member, wherein the members are attached to form an equilateral triangle, wherein from substantially the midpoint of each member of the equilateral triangle extends inward toward a shaft a shaft support rod, wherein the inward ends of the three shaft support rods are rigidly attached to the shaft having a front end and a rear end, wherein the front end is rotatably inserted into the front pillow block, (2) a rear assembly in alignment with said front assembly also having a first member, a second member and a third member, that are attached to form an equilateral triangle, wherein from substantially the midpoint of each member of the equilateral triangle extends inward toward a shaft a shaft support rod, wherein the inward ends of the three shaft support rods are rigidly attached to the shaft, wherein the rear end of the shaft is rotatably inserted into the rear pillow block, c) a first bench attached to the first members of said front and rear assemblies of said triangular bench support structure, d) a second bench attached to the second members of said front and rear assemblies of said triangular bench support structure, e) a third bench attached to the third member of said front and rear assemblies of said triangular bench support structure, and f) means for selectively releasing and locking said triangular bench support structure to a selectable first, second or third bench position.

2. The rotatable work bench as specified in claim 1 wherein said means for releasing and locking said triangular bench support structure comprises a trip lever which activates a two-position latch that in a first position maintains said bench support structure in a selected first position and in a second position allows said triangular bench support structure to be rotated to a second or third position.

3. The rotatable work bench as specified in claim 1 further comprising a set of casters attached to the lower surface of said horizontal member of said front and rear frames.

4. A rotatable work bench comprising:

a) a bench support structure comprising:

(1) a front frame having a left vertical member, a right vertical member, an upper horizontal member, a lower horizontal member, an inner horizontal member and an inner vertical member, wherein substantially centered on the upper surface of the inner horizontal member is attached a front pillow block, (2) a rear frame in alignment with said front frame and also having a left vertical member, a right vertical member, an upper horizontal member, a lower horizontal member, an inner horizontal member and an inner vertical member, wherein substantially centered on the upper surface of the inner horizontal member is attached a rear pillow block in alignment with said front pillow block, b) a triangular bench support structure comprising:

(1) a front assembly having a first member, a second member and a third member, wherein all three members are attached to form an equilateral triangle, wherein from substantially the midpoint of each of the first, second and third members extends inward toward a shaft a shaft support rod, wherein the inward ends of the three shaft support rods are rigidly attached to the shaft having a front end and a rear end, wherein the front end is rotatably inserted into the front pillow block, (2) a rear assembly in alignment with said front assembly and also having a first member, a second member and a third member, wherein all three members are attached to form an equilateral triangle, wherein from substantially the midpoint of each of the first, second and third members extends inward toward the shaft a shaft support rod, wherein the inward ends of the three shaft support rods are rigidly attached to the shaft, wherein the rear end of the shaft is rotatably inserted into the rear pillow block, c) a first bench attached to the first members of said front and rear assemblies of said triangular bench support structure, d) a second bench attached to the second members of said front and rear assemblies of said triangular bench support structure, e) a third bench attached to the third members of said front and rear assemblies of said triangular bench support structure, and f) means for selectively releasing and locking said triangular bench support structure at a selectable first, second or third bench position.

5. The rotatable work bench as specified in claim 4 wherein said means for releasing and locking said triangular bench support structure comprises a trip lever which activates a two-position latch that in a first position maintains said triangular bench support structure in a selected first position and in a second position allows said triangular bench support structure to be rotated to a second or third position.

6. The rotatable work bench as specified in claim 4 further comprising a drawer assembly having a vertical side positioned adjacent to a first side of said bench support structure, an upper surface in linear alignment with the upper horizontal members of said front and rear frames and a lower surface in linear alignment with the lower horizontal members of said front and rear frames.

7. The rotatable work bench as specified in claim 6 wherein said drawer assembly having means for being rigidly attached to the first side of said bench support structure.

8. The rotatable work bench as specified in claim 4 further comprising a shelf assembly having a vertical side position adjacent to a second side of said bench support structure, an upper surface in linear alignment with the upper horizontal members of said front and rear frames and a lower surface in linear alignment with the lower horizontal members of said front and rear frames.

9. The rotatable work bench as specified in claim 8 wherein said shelf assembly having means for being rigidly attached to the second side of said bench support structure.

10. The rotatable work bench as specified in claim 4 further comprising a set of casters attached to the lower surface of the lower horizontal members of said front and rear frames and to the lower surfaces of said drawer assembly and said shelf assembly.

11. A rotatable work bench comprising:

a) a bench support structure comprising:

(1) a front frame having a left vertical member, a right vertical member, an upper horizontal member, a lower horizontal member, an inner horizontal member and an inner vertical member, wherein substantially centered on the upper surface of the inner horizontal member is attached a front pillow block and an electrical transfer block, (2) a rear frame in alignment with said front frame and also having a left vertical member, a right vertical member, an upper horizontal member, a lower horizontal member, an inner horizontal member and an inner vertical member wherein substantially centered on the upper surface of the inner horizontal member is attached a rear pillow block in alignment with said front pillow block, b) a triangular bench support structure comprising:

(1) a front assembly having a first member, a second member and a third member, wherein all three members are attached to form an equilateral triangle, wherein from substantially the midpoint of each of the first, second and third members extends inward toward a shaft a shaft support rod, wherein the inward end of the three shaft support rods are rigidly attached to the shaft having a front end and a rear end, wherein the front end is rotatably inserted into the front pillow block, wherein adjacent the rear surface of the front pillow block is rigidly attached to the shaft an electrical-power transfer disc, (2) a rear assembly in alignment with said front assembly and also having a first member, a second member and a third member, wherein all three members are attached to form an equilateral triangle, wherein from substantially the midpoint of each of the first, second and third members extends inward toward a shaft a shaft support rod, wherein the inward end of the three shaft support rods are rigidly attached to the shaft, wherein the rear end of the shaft is rotatably inserted into the rear pillow block, c) a first bench attached to the first members of said front and rear assemblies of said triangular bench support structure, d) a second bench attached to the second members of said front and rear assemblies of said triangular bench support structure, e) a third bench attached to the third member of said front and rear assemblies of said triangular bench support structure, and f) a mounting plate attached to a corner of said front frame, wherein to said plate is attached a means for releasing and locking said triangular bench support structure, and an electrical power switch which is connected to an external electrical power source, wherein when said electrical power switch is closed, the electrical power source is applied sequentially through a set of electrical connectors to said electrical-power transfer disc from where the power is routed to a selectable power tool mounted to at least one of said first second or third benches.

12. The rotatable work bench as specified in claim 11 wherein said external electrical power source consist of a utility power source that supplies 120-volts a-c.

13. The rotatable work bench as specified in claim 11 wherein said power tool comprises a dual grinder, a router or a like power tool.

14. The rotatable work bench as specified in claim 11 further comprising a drawer assembly having a vertical side positioned adjacent to a first side of said bench support structure, an upper surface in linear alignment with the upper horizontal members of said front and rear frames and a lower surface in linear alignment with the lower horizontal members of said front and rear frames.

15. The rotatable work bench as specified in claim 14 wherein said drawer assembly having means for being rigidly attached to the first side of said bench support structure.

16. The rotatable work bench as specified in claim 11 further comprising a shelf assembly having a vertical side attached to a second side of said bench support structure, an upper surface in linear alignment with the upper horizontal members of said front and rear frames and a lower surface in linear alignment with the lower horizontal members of said front and rear frames.

17. The rotatable work bench as specified in claim 16 wherein said shelf assembly having means for being rigidly attached to the second side of said bench support structure.

18. The rotatable work bench as specified in claim 11 further comprising a set of casters attached to the lower surface of said horizontal member of said front and rear frames and to the lower surfaces of said drawer assembly and said shelf assembly.

19. The rotatable work bench as specified in claim 11 further comprising a carpet or a rubber matting attached to at least one of said benches.

20. The rotatable work bench as specified in claim 11 wherein said front and rear frames are constructed from 1.00 steel square tubing having a 0.125-inch wall thickness and welded together by an MIG welding process.

* * * * *